US005793151A

United States Patent [19]

Kagawa et al.

[11] Patent Number: 5,793,151

[45] Date of Patent: Aug. 11, 1998

[54] CREEPING DISCHARGE SPARK PLUG

[75] Inventors: Junichi Kagawa; Kozo Amano; Yoshihiro Matsubara, all of Nagoya, Japan

[73] Assignee: NGK Spark Plug Co., Ltd., Nagoya, Japan

[21] Appl. No.: 717,454

[22] Filed: Sep. 20, 1996

[30] Foreign Application Priority Data

| | | | |
|---|---|---|---|
| Sep. 20, 1995 | [JP] | Japan | 7-241612 |
| May 28, 1996 | [JP] | Japan | 8-132903 |

[51] Int. Cl.[6] ..... H01T 13/52

[52] U.S. Cl. ..... 313/141; 313/130; 313/131 R

[58] Field of Search ..... 313/130, 131 R, 313/141

[56] References Cited

U.S. PATENT DOCUMENTS

| | | | |
|---|---|---|---|
| 2,899,585 | 8/1959 | Dollenberg | 313/143 |
| 2,957,099 | 10/1960 | Dutterer | 313/143 |
| 5,440,198 | 8/1995 | Oshima et al. | 313/141 |
| 5,448,130 | 9/1995 | Matsutani et al. | 313/141 |

FOREIGN PATENT DOCUMENTS

| | | | |
|---|---|---|---|
| 0 575 163 | 12/1993 | European Pat. Off. | H01T 13/39 |
| 0 624 938 | 11/1994 | European Pat. Off. | H01T 13/39 |
| 846 638 | 8/1952 | Germany . | |
| 60-232679 | 11/1985 | Japan | H01T 13/52 |
| 7-73956 | 3/1995 | Japan | H01T 13/52 |

OTHER PUBLICATIONS

Patent Abstracts of Japan, vol. 13, No. 544 (E-855), Dec. 6, 1989, & JP-A-01 225085 (NGK Spark Plug Co., Ltd.) Sep. 7, 1989, *abstract*.

*Primary Examiner*—Sandra L. O'Shea
*Assistant Examiner*—Michael Day
*Attorney, Agent, or Firm*—Sughrue, Mion, Zinn, Macpeak & Seas, PLLC

[57] ABSTRACT

A spark plug in use for an internal combustion engine, includes an insulator placed in a metal shell in a manner to extend its front end beyond the metal shell, a center electrode is placed within an axial bore provided by the insulator, an outer electrode which is welded to a front end of the metal shell is so bent that a firing end of the outer electrode faces a front end of the insulator with a space therebetween to cause surface-spark discharges along a front end surface of the insulator and to cause a semi-surface spark discharge between the center electrode and the outer electrode, the front end of the center electrode is protroacted from a front end of the insulator by at most than 0.5 mm or retracted from the front end of the insulator by at most than 1.0 mm, and the firing end of the outer electrode is in line with the front end surface of the insulator, thereby optimizing a carbon-deposit cleaning performance of the spark plug with the semi-surface spark discharge, according to the invention.

In addition, a firing end portion of the center electrode has a slender noble metal tip in a preferred embodiment of the spark plugs of the invention.

15 Claims, 8 Drawing Sheets

31
P
301
30

33
31
30

31
3
311 w:diameter of center electrode 340
303
302

37
30

304
34
30

32
34
b
a
30

CREEPING DISCHARGE SPARK PLUG

BACKGROUND OF THE INVENTION

1. Field of the Invention

The present invention relates to a spark plug, more specifically to a semi-surface discharge type spark plug in use for an internal combustion engine in which a dimensional relationship and a locational relationships among a front end of a center electrode, that of an insulator and a firing end of an outer electrode is improved to be conducive to an extended service life.

2. Description of the Prior Art

A semi-surface discharge or rather semi-surface creeping type spark plug (J) has been introduced as shown in FIG. 7. The spark plug (J) has a cylindrical metal shell 100 in which an insulator 104 is placed so that a front end 101 of the insulator 104 extends beyond a front end 102 of the metal shell 100. A center electrode 105 is placed through an axial bore 103 of the insulator 104 with the front end of the center electrode 105 extended from the insulator 104 by a length (t) of 1.2–1.5 mm. An L-shaped outer electrode 106 is welded to the front end 102 of the metal shell 100 to form a spark discharge between the center electrode 105 and a firing end 107 of the outer electrode 106 along a front end surface 108 of the insulator 104. To the front end (firing end) of the center electrode 105, is a spark erosion resistant noble metal tip 109 welded.

Compared to an air-gap type spark plug, this type of the spark plug (J) is generally superior in soot or carbon-fouling resistance because the spark discharge which creeps along the front end surface 108 enables to burn out a pile of carbon deposit on the surface of the insulator 104.

However, a greater length (t) of the center electrode 105 decreases the likelihood that the spark discharge runs along the front end surface 108 of the insulator 104. According to a soot fouling test (Based on JIS: D-b 1616,temperature −10° C.) carried out along the pre-delivery pattern simulated to traffic congestion in a cold district in a low temperature with the use of 6-cylinder, 2500 cc gasoline engine, it was found that an insulation resistance of the insulator 104 had reduced lower than 10 MΩ after 2–4 cycles of the soot fouling test.

Therefore, it is an object of the invention to provide an improved semi-surface creeping type spark plug for an internal combustion engine which is especially superior in the carbon fouling resistance.

SUMMARY OF THE INVENTION

According to the present invention, there is provided a spark plug comprising: a cylindrical metal shell and an insulator placed in the metal shell in a manner to extend a front end of the insulator beyond the metal shell, a center electrode placed within an axial bore provided by the insulator, and an outer electrode bonded to a front end of the metal shell and so bent that a firing end of the outer electrode faces a front end of the insulator to cause spark discharges along the front end surface of the insulator; wherein the front end of the center electrode protoracting from a front end of the insulator by at most than 0.5 mm or retracted backward from the front end of the insulator by at most than 1.0 mm, and the front end of the insulator keeps in line with the firing end of the outer electrode.

According to another aspect of the present invention, an inner edge of an open front end of the insulator is bevelled.

According to still another aspect of the present invention, the number of the outer electrode is 3–4.

According to other aspect of the present invention, a noble metal tip is welded to an end of a center electrode to form the front end of the center electrode, a diameter of the noble metal tip being substantially equivalent to that of the front end portion of the center electrode.

According to other aspect of the present invention, the noble metal tip is formed into a disk-shaped configuration which measures 1.0~2.5 mm in diameter, and 0.3~1.0 mm in thickness, the noble metal tip being welded within the bore of the insulator.

According to other aspect of the present invention, the noble metal tip is placed circumferentially around the front end portion of the center electrode metal.

According to other aspect of the present invention, on the front end of the center electrode metal an annular noble metal tip whose outer diameter is the same or less than that of the center electrode metal is provided, the annular noble metal tip measuring 0.3~1.5 mm in height and 0.2~0.5 mm in thickness.

According to other aspect of the present invention, to the front end portion of the center electrode the annular noble metal tip is welded circumferentially around the front end of the center electrode metal by laser.

According to other aspect of the present invention, at the front end of the center electrode the annular noble metal tip is formed by extrusion process.

According to other aspect of the present invention, a voltage applied to the center electrode has a negative polarity for spark discharge.

In the spark plug in which a cylindrical metal shell and an insulator placed in the metal shell in a manner to project the front end of the insulator beyond the metal shell end, and having an outer electrode bonded to a front end of the metal shell so that a firing end of the outer electrode is bent to face a front end of the outer electrode, the spark discharge is not likely to occur along the front end of the insulator in accordance with the increase of the extension length (t) of the front end of the center electrode projected more than 0.5 mm from the insulator end. With the increase of the retraction distance (t') retracted backward 0–1.0 mm from the front end of the insulator, the spark discharge between the electrodes is on the contrary likely to occur along the front end surface of the insulator, according to the invention.

When the extension length (t) is less than 0.5 mm or the retraction distance (t') is less than 1 mm and the outer electrode end keeps in line with the front end of the insulator, the spark discharge is likely to occur appropriately along the front end surface of the insulator so as to insure a self-cleaning action to decrease the pile of the carbon deposit. When the retraction length exceeds 1.0 mm and the outer electrode end keeps in line with the front end of the insulator, the spark discharge is likely to advance spark erosion of the front end surface of the insulator due to the action of channeling, thereby possibly causing chips coming off the insulator.

with the above dimensional arrangement between the front end of the center electrode and that of the insulator, it is possible to increase the carbon fouling resistance and durability of the spark plug. With the diameter of front end of the center electrode defined from 1.0~2.5 mm, it is possible to improve an ignitability of the spark plug with a least amount of spark erosion.

With the inner edge of the open front end of the insulator bevelled or chamfered, it is possible to increase the likelihood that the semi-surface creeping occurs while insuring a greater dispersion of the spark discharge paths. It is preferable that the chamfer is more than 0.1~0.8 mm.

With the number of the outer electrode to be 3–4, it is possible to more disperse the spark discharge paths so as to ease the spark erosion or channeling of the insulator, and thereby ameliorating the self-cleaning action to improve the carbon fouling resistance.

By welding the noble metal tip to the front end of the center electrode metal with the diameter of the noble metal tip being substantially equivalent to that of the front end portion of the center electrode metal, it is possible to decrease the amount of spark erosion so as to improve the spark erosion resistance. The noble metal can be selected from the group consisting of Pt, Pt-Ir, Pt-Ir-Ni, Au-Pd, Ir, Ir-$Y_2O_3$ and Ir-Rh.

With the noble metal tip formed into the columnar-shaped or rather disk-shaped configuration which measures 1.0~2.5 mm in diameter, it is possible to improve the ignitability of the spark plug with a least amount of spark erosion.

When the thickness of the noble metal tip is short of 0.3 mm, it is too thin to prevent the tip from being prematurely spark-eroded. Although the spark erosion resistance is improved as the thickness of the noble metal tip is increased, it is desirable that the thickness of the noble metal tip may be less than 1.0 mm when its cost is taken into consideration. It is possible to prevent the welding portion form further being spark eroded in the case that the welded portion between the noble metal tip and the front end of the center electrode lies backward from the front end of the insulator, in other words, within the bore of the insulator.

with the noble metal placed circumferentially around the front end of the center electrode metal, it is also possible to improve the durability of the center electrode with a least amount of spark erosion. By providing the front end portion of the center electrode with the annular noble metal tip or rather ring whose outer diameter is the same or less than the center electrode metal, the annular noble metal tip measuring 0.3~1.5 mm in height and 0.2~0.5 mm in thickness, it is possible to ease the amount of the spark erosion so as to ameliorate the durability.

By providing the front end portion of the center electrode with the annular noble metal tip welded by laser circumferentially around the front end of the center electrode metal, it is possible to further improve the durability of the center electrode with a least amount of spark erosion.

By providing the front end of the center electrode with the annular noble metal tip provided by means of extruding the center electrode metal or by means of resistance-welding, it may be possible to manufacture the center electrode with a relatively low cost.

By arranging a spark discharge voltage applied to the center electrode to be in a negative polarity, it is possible to readily stimulate a bombardment ionization so as to ameliorate the ignitability with a low discharge voltage.

DETAILED DESCRIPTION OF THE PREFERRED EMBODIMENT OF THE INVENTION

Figure 1A:
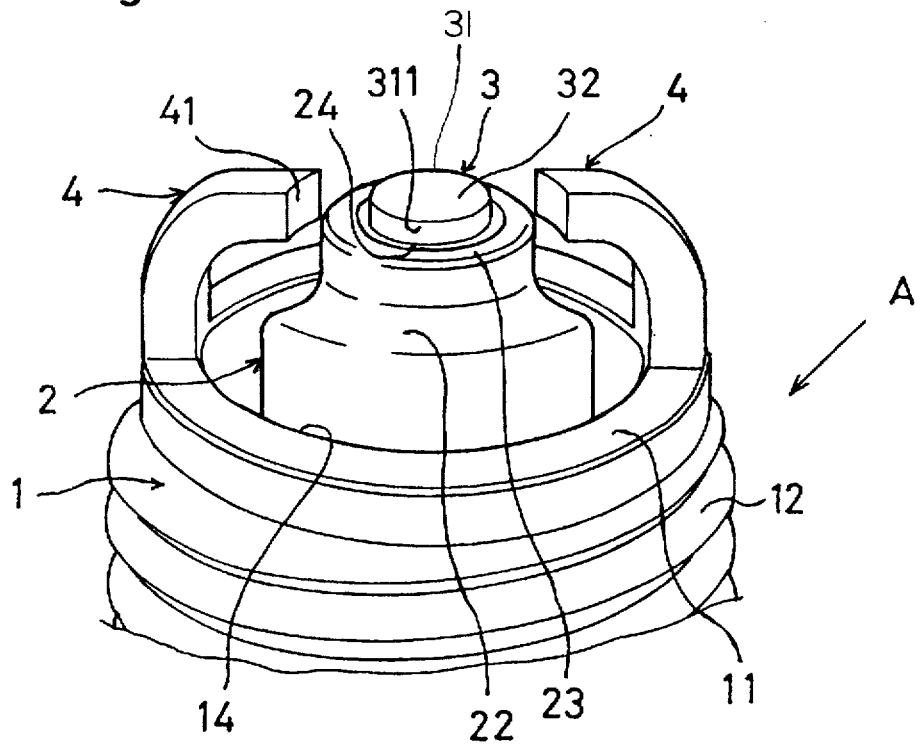
FIG. 1*a* is a perspective view of a main portion of a dual-gap type spark plug according to a first embodiment of the invention.
Figure 1B:
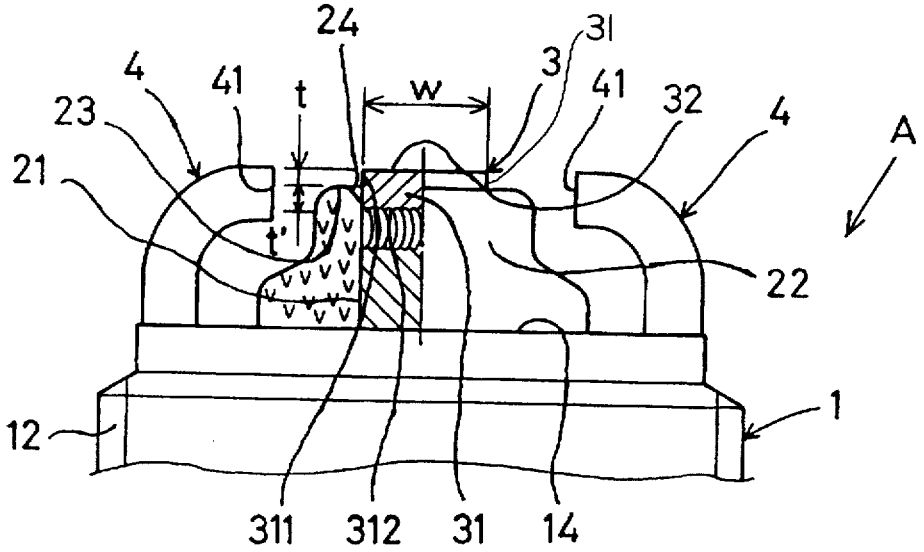
FIG. 1*b* is a longitudinal cross sectional view of the main portion of the dual-gap type spark plug.

Referring to FIGS. 1*a*, 1*b*, 2*a*, 2*b*, and 2*c* which show a first embodiment of the present invention, a dual-gap type spark plug (A) has a cylindrical metal shell 1 in which an insulator 2 is placed. Within an axial bore 21 provided by the insulator 2, a center electrode 3 which has a noble tip 31 welded to a front end or rather top of the center electrode 3 is supported. From a front end 11 of the metal shell 1, a pair of outer electrodes 4, 4 are extended so that the outer electrodes 4, 4 and bent inwardly to have a firing end 41 to space-oppose to the noble metal tip 31.

The metal shell 1 is made of a low carbon steel whose front end 11 connects the outer electrodes 4, 4 by means of a welding procedure. An outer surface of the metal shell 1 has a male thread 12 with which the spark plug is mounted on a cylinder head of an internal combustion engine by way of a gasket (each not shown).

The insulator 2 is made of an alumina ceramic. Within the metal shell 1, the insulator 2 engages its shoulder with a stepped portion of the metal shell 1 by way of a packing. By caulking a hexagonal head of the metal shell 1, the insulator 2 is fixedly supported by the metal shell 1. The front end portion 22 of the insulator 2 is slenderized and extended slightly beyond an front open end 14 of the metal shell 1. In this instance, a front end surface 23 of the insulator 2 is flatten to realize a semi-surface creeping of spark discharge with its inner edge bevelled (Chamfer: 0.3 mm) all through its circumferential length as designated by numeral 24.

The center electrode 3, which measures 1.0–2.5 mm in diameter (w), is made of Ni-based alloy e.g., Inconel 600 in which a heat-conductor core is embedded. To a front end of the Ni-based electrode, the noble metal tip 31 is laser-welded as described in detail hereinafter. A position 312 where the noble metal tip 31 is welded to the electrode metal is retracted 0.3 mm or more inward from the front end surface 23 of the insulator 2.

The center electrode 3 is so arranged that its front end 32 via., front end of the noble metal tip extends by 0–0.5 mm (t) beyond the front end surface 23 of the insulator 2. Alternatively, the front end 32 (viz., front end of the noble metal tip) can be retracted by 0–1.0 mm inward from the front end surface 23 of the insulator 2. Because a thinned end of the center electrode 3 stimulates a bombardment ionization to induce the spark discharge at a low discharge voltage when the thinned end is in the negative polarity, a high tension voltage applied to the center electrode 3 is in the negative polarity against the metal shell 1.

The noble metal tip 31 is a disk made of a alloy e.g., Pt-20Ir, which measures 1.0–2.0 mm in diameter (w), and 0.3–1.0 mm in thickness (p) before welding it to the front end of the center electrode metal.

The outer electrodes 4, 4 are made of Ni-based alloy e.g., Inconel 600 which is formed into a L-shaped configuration. A leading end (firing end 41) of the outer electrodes 4, 4 is bent toward the front end of the center electrode 3 to space oppose to an elevational surface of a slenderized portion 22 of the insulator 2. Between the elevational surface 311 of the noble metal tip 31 and the firing end 41 of the outer electrodes 4, 4, there is located the front end surface 23 of the slenderized portion 22 of the insulator 2, where the surface spark discharge creeps along in line with the firing end of the outer electrode. The space or rather gap between the firing end 41 of the outer electrode and the elevational surface of the slenderized portion 22 of the insulator 2 is about 0.5 mm.

Figure 2A:
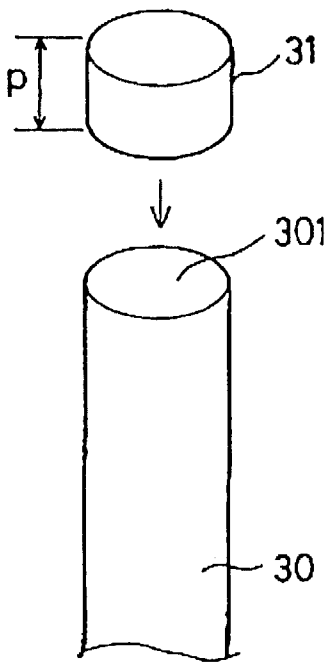
FIGS. 2*a*–2*c*. are sequential views showing how a center electrode is manufactured in the case of the dual-gap type spark plug according to the first embodiment of the invention.
Figure 2B:
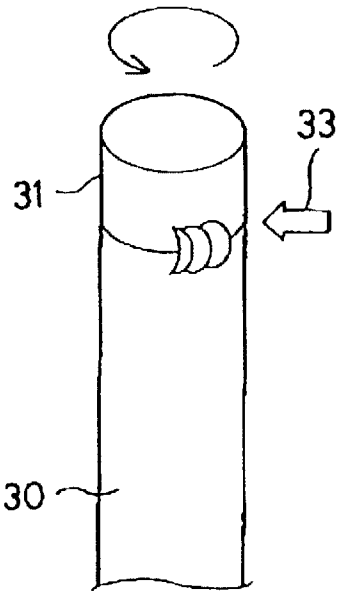
Figure 2C:
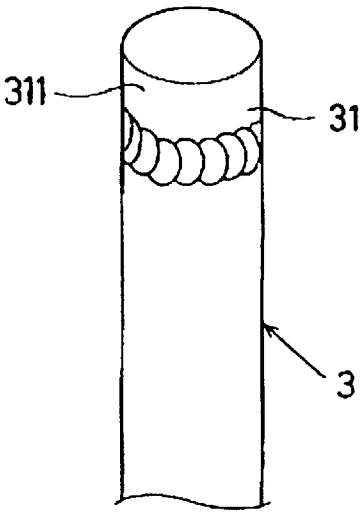

With reference to FIGS. 2*a*–2*c*, a method of making the center electrode 3 is explained as follows:

STEP 1

(i) The noble metal tip 31 is placed on the front end surface 301 of the center electrode metal 30 as shown in FIG. 2*a*.

STEP 2

(ii) While revolving the center electrode metal 30 around its axis at a predetermined rpm, laser beams 33 are intermittently applied from the side to an interface between the noble metal tip 31 and the front end surface 301 of the center electrode metal 30 with regular intervals as shown in FIG. 2*b*, thereby to weld the interfacing portion.

STEP 3

(iii) By solidifying the welded portion between the noble metal tip 31 and the front end surface 301 of the center electrode metal 30, the noble metal tip 31 is integrally fused with the front end surface 301 of the center electrode metal 30 so as to complete the center electrode 3.

Figure 3:
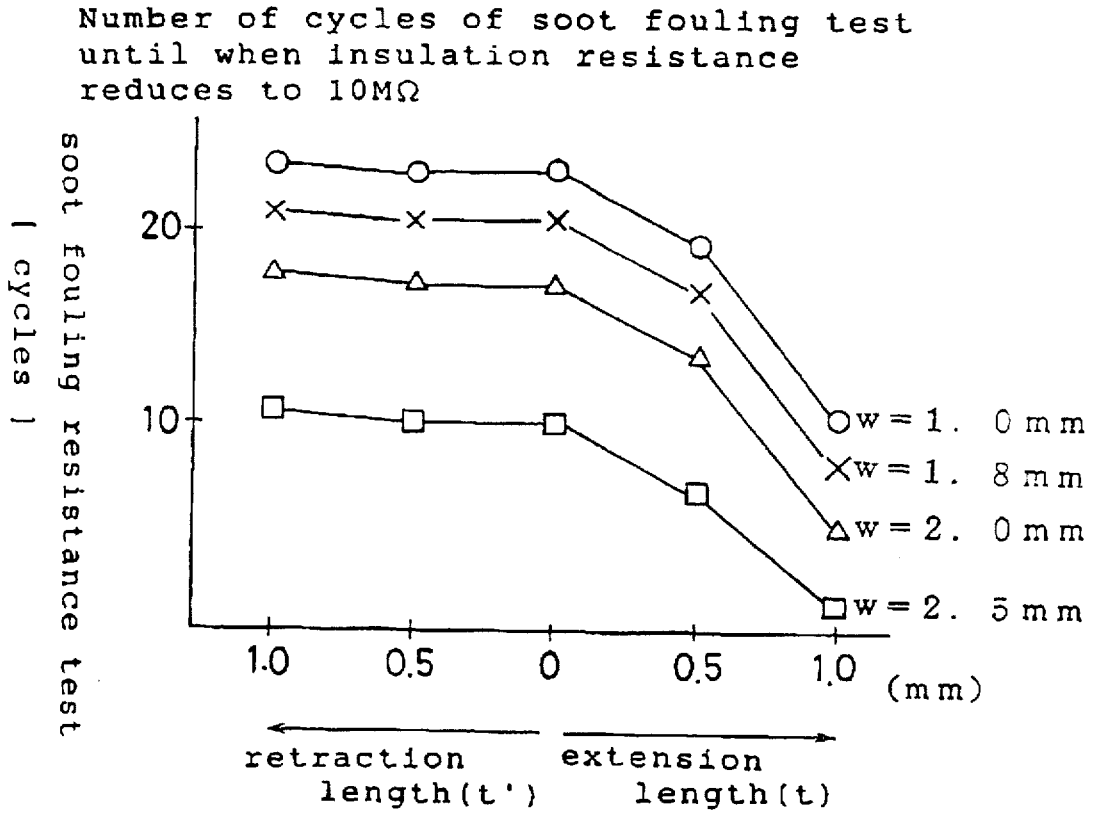
FIG. 3 is a graphical representation showing how an extension length t (or retraction length t') affects an insulation resistance of an insulator of a spark plug until the resistance is reduced to 10 MΩ depending on the number of cycles in a carbon-fouling test.
Figure 8:
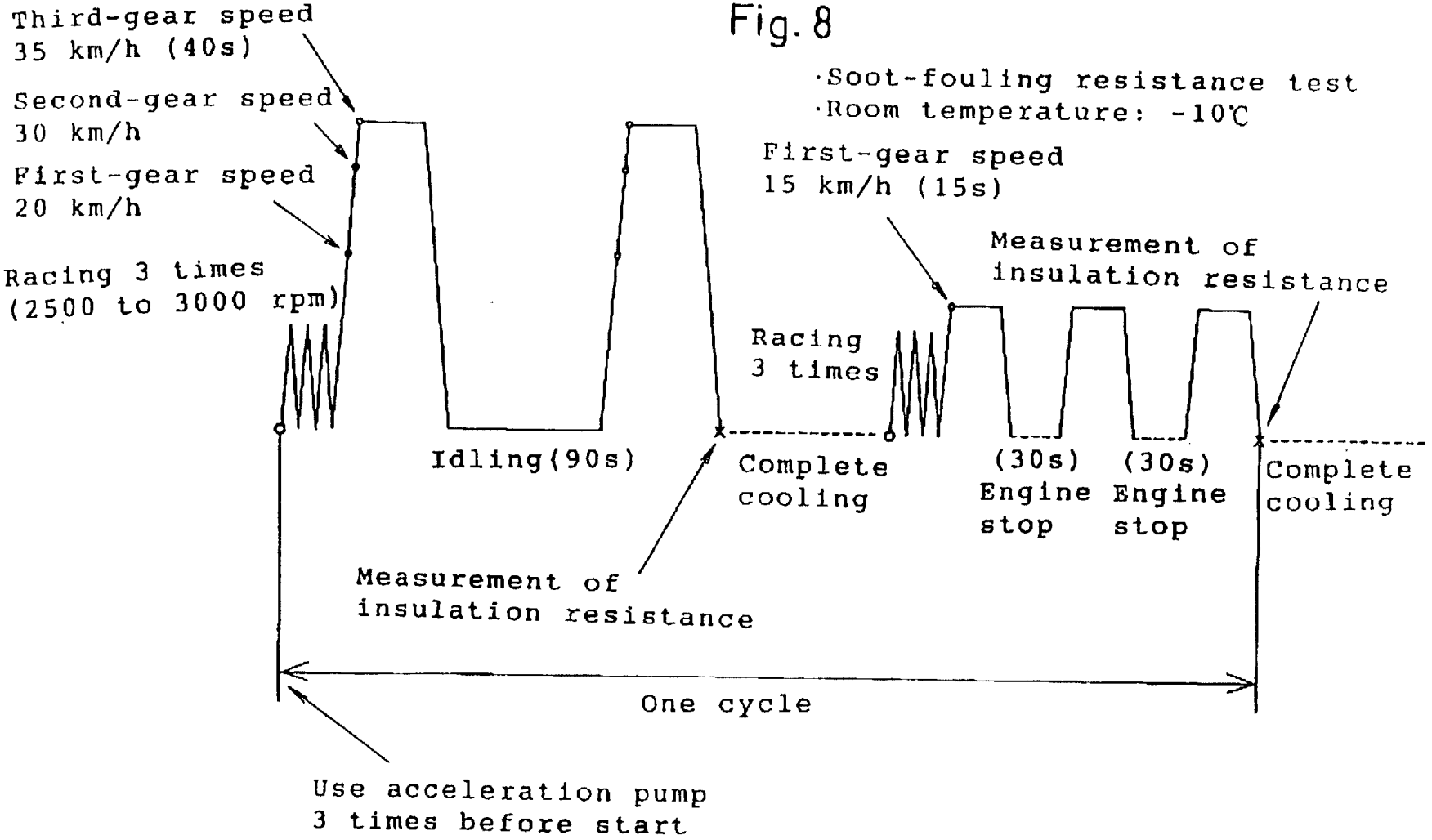
FIG. 8 show a soot-fouling resistance test pattern conducted on spark plug samples.

FIG. 3 shows a relationship between the carbon or rather soot fouling resistance and the extension length (t) or the retraction distance t' of the center electrode 3 from the front end portion 23 of the insulator 2, in which the carbon fouling resistance of the spark plug is determined in terms of cycles until when the insulation resistance of the insulator 2 reduces to 10 MΩ in accordance to the soot-fouling test of JIS D1606 as shown in FIG. 8.

Upon carrying out the soot fouling resistance test on the spark plugs, four types of center electrode metals having noble metal tips were prepared whose diameter (w) in turn 1.0 mm, 1.8 mm, 2.0 mm and 2.5 mm and also four types of the slenderized portions of the insulator each having the outer diameter in turn 2.0 mm, 3.8 mm, 4.0 mm and 4.5 mm were prepared in accordance with the increase of the diameter of the noble metal tip. Twenty spark plugs were prepared in each of which the extension length (t) or the retraction distance (t') was in turn 0 mm, 0.5 mm and 1.0 mm. The carbon fouling resistance test was conducted with the pre-delivery pattern of JIS (D1606) on the spark plugs alternately mounted on 6-cylinder, 2500 cc gasoline engine.

From the soot (carbon) fouling resistance test, it was found that the soot fouling resistance is ameliorated as the diametrical dimension of the front end of the center electrode metal 30 (viz., noble metal tip 31) gets thinner as judged by FIG. 3. It is, however, necessary to insure at least 1.0 mm for the diameter of the center electrode metal 30 upon taking the spark erosion into consideration.

On the conditions that the diametrical dimension of the front end of the center electrode metal 30 is less than 2.5 mm, it is possible to insure a good soot fouling resistance of the spark plug with the extension length (t) more than 0.5 mm. It is necessary to insure at most 1.0 mm for the retraction length (t') because the excessive retraction length (t') facilitates the channeling on the front end surface 23 of the insulator 2 so as to induce cracks or damage thereof.

ADVANTAGES (a) By determining the extension length (t) to be less than 0.5 mm or the retraction length (t') to be less than 1.0 mm, it is possible to run the spark discharge on the front end surface 23 of the insulator 2 so as to ameliorate the soot fouling resistance remarkably in the dual-gap type spark plug (A) compared to the prior art counterpart (J). In addition with the retraction length (t') to be less than 1.0 mm, the bevelled portion 24 is provided at the inner circumferential edge of the front open end of the insulator 2. This makes it possible to jump the spark discharge significantly apart from the front end surface 23 of the insulator 2 so as to substantially delay the channeling. The bevelled portion is preferably about 0.2–0.5 mm.

With the front end portion of the center electrode metal 30 having the noble metal sufficiently thinned as nearly as 1.0–2.0 mm in diameter, it is possible to improve the ignitability with a least amount of spark erosion.

(b) With the disk-shaped noble metal tip 31 measured 0.3–1.0 mm in thickness, it is possible to effectively ease the spark erosion with a relatively low cost. When additionally taking the bevelled portion 24 into consideration, the bevelled portion 24 contributes to lessening the spark erosion and improving the fouling resistance. With the welding position 312 of the noble metal tip 31 retracted by a least 0.3 mm inward from the front end surface 23, it is possible to prevent the Ni-based alloy of the center electrode from inducing the spark so as to effectively protect the center electrode 3 from spark erosion.

(c) With the noble metal tip 31 welded by the laser to the front end surface 301 of the center electrode metal 30 to form the front end portion of the center electrode 3, it is possible to significantly reduce the spark erosion of the front end portion so as to ameliorate the spark erosion resistance of the dual-gap type spark plug (A).

Referring further to FIGS. 4*a*, 4*b* and 5*a*–5*d* which all relate to a dual-gap type spark plug (B) according to a second embodiment of the invention, the spark plug (B) has the cylindrical metal shell 1 in which the insulator 2 is fixedly placed. Within the axial bore 21 of the insulator 2, the center electrode 3 is firmly placed whose front end has a noble metal alloy portion 34. The outer electrodes 4, 4 are extended from the front end 11 of the metal shell 1 so that the firing end 41 is bent keeping in line with the front end surface 23 of the insulator 2 to space oppose to an elevational surface of the slenderized portion of the insulator 2.

A main portion of the center electrode 3 is diametrically increased to facilitate its heat-dissipation effect, while the front end portion of the center electrode 3 is slenderized to be w (diameter)=1~2 mm to insure a good ignitability. Embedded is a heat-conductive copper core 36 in a Ni-based alloy 35 (Inconel 600) of the center electrode metal 30.

Figure 4A:
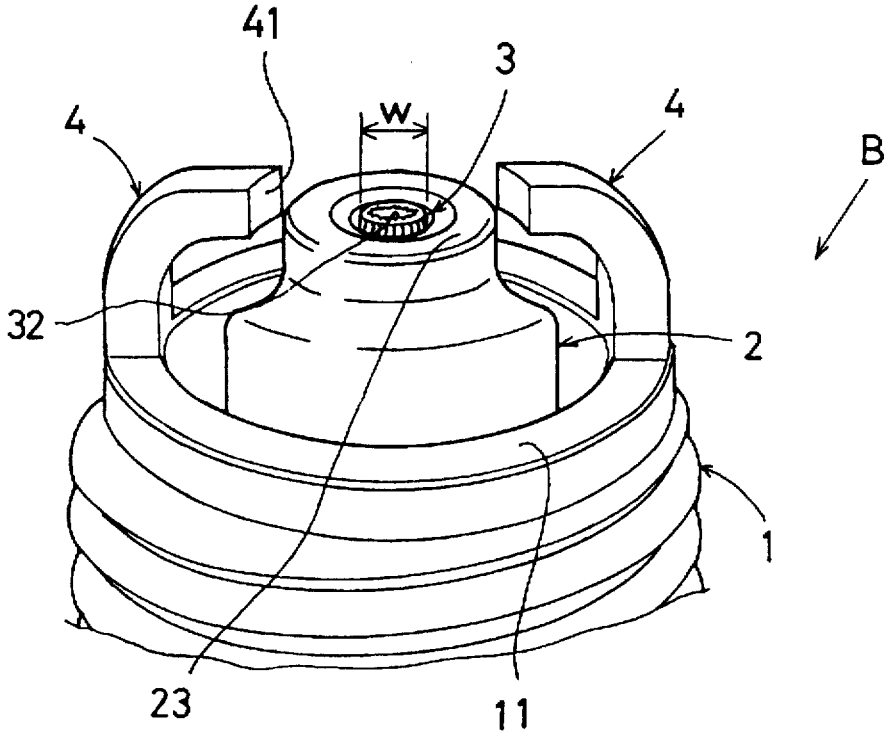
FIG. 4*a* is a perspective view of a main portion of a dual-gap type spark plug according to a second embodiment of the invention.
Figure 4B:
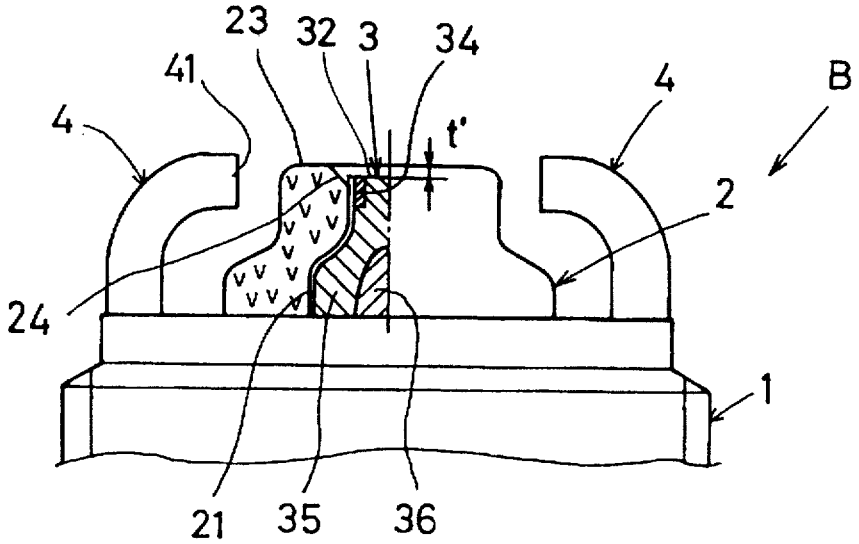
FIG. 4*b* is a longitudinal cross sectional view of the main portion of the dual-gap type spark plug according to the second embodiment.

The center electrode 3 can extend its front end 32 by 0–0.5 mm (t) beyond the front end surface 23 of the insulator 2, or otherwise, the center electrode 3 retracts its front end 32 by 0–1.0 mm (t') backward from the front end surface 23 of the insulator 2 as shown in FIG. 4*b*.

With reference to FIGS. 5*a*–5*d*, a method of making the center electrode 3 is explained follows:

STEP 1

Figures 5A, 5B, 5C, 5D:
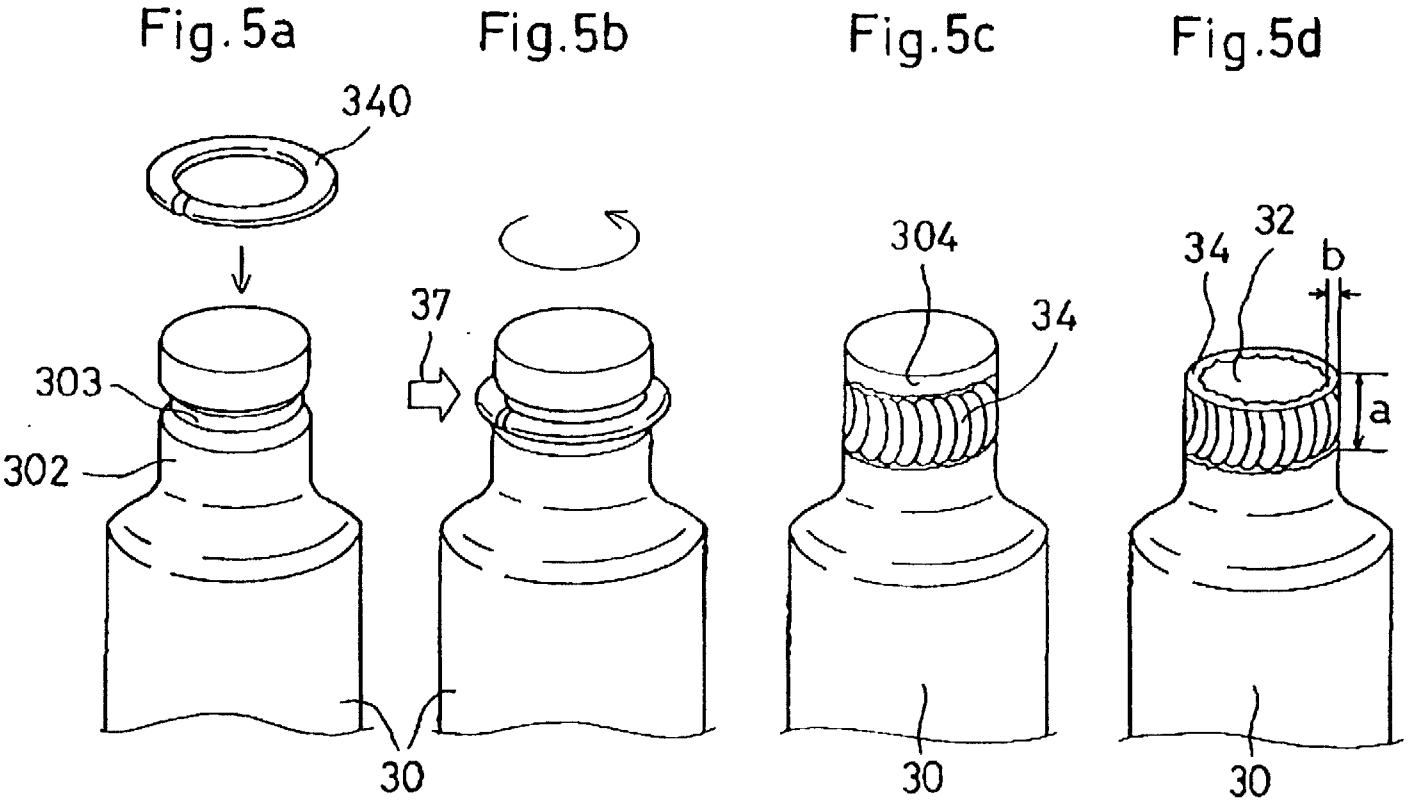
FIGS. 5*a*–5*d* are sequential views showing how a center electrode is manufactured for a spark plug according to the invention.

(i) Circumferentially provided with a diametrically reduced front end portion 302 of the center electrode metal 30, is a groove 303 trapezoidal in section as shown in FIG. 5*a*. A platinum wire 340 is tightly placed in the groove 303 by means of a caulking procedure. In this instance, a length of the platinum wire 340 substantially corresponds to a circumferential length of the groove 303.

STEP 2

(ii) Laser beams 37 are applied to the platinum wire 340 while revolving the center electrode metal 30 as indicated in FIG. 5*b* at the rate of $5\pi/6$ rad/sec. In this instance, a YAG laser device is preferably used with a pulse width, standard energy and operative time period as 2 ms, 7 Joules and 5 pps respectively by way of illustration.

STEP 3

(iii) The application of the laser beams 37 thermally fuses the platinum wire 340 into the front end of the center electrode metal 30 to provide the noble metal alloy portion 34 as shown in FIG. 5*c*.

STEP 4

(vi) As shown in FIG. 5*d*, a top or front end portion 304 of the center electrode metal 30 is removed to be flush as depicted by numerical 32 by severing, milling or grinding procedure to expose the noble metal alloy portion 34 so as to complete the center electrode 3, of FIG. 4*a*.

Regarding to the dual-gap type spark plug (B), the soot fouling resistance test was carried out in the same manner as done on the dual-gap type spark plug (A).

From the soot fouling resistance test, it was found that the soot fouling resistance is ameliorated as the diameterical dimension (w) of the front end portion of the center electrode 3 (viz., noble metal tip 31) gets thinner as shown in FIG. 3.

It is, however, necessary to insure at least 1.0 mm for the diameter of the center electrode metal 30 upon taking its spark erosion into consideration.

When the diametrical dimension of the main portion of the center electrode 30 is less than 2.5 mm, it is possible to insure a good carbon fouling resistance with the extension length (t) less than 0.5 mm. It is necessary to insure at most 1.0 mm for the retraction distance (t') because an excessive retraction distance (t') causes the channeling on the front end surface 23 of the insulator 2 so as to induce cracks or damage thereof.

ADVANTAGES (a) With the main portion of the center electrode 3 provided to be diametrically increased, it is possible to effect a good heat-dissipating action. With the diameter (w) of the front end of the center electrode 3 arranged to be 1.0 to 2.5 mm, it is possible to ameliorate the ignitability further when taking it into consideration that the high tension voltage is applied to the center electrode 3 in the negative polarity against the metal shell 1.

(b) By determining the extension length (t) to be less than 0.5 mm or the retraction distance (t') to be 1.0 mm, it is possible to run the spark discharge on the front end surface 23 of the insulator 2 so as to ameliorate the carbon fouling resistance remarkably in the dual-gap type spark plug (B) compared to the prior art counterpart (J). In addition to the retraction distance (t') less than 1.0 mm, the bevelled portion 24 is provided at the inner edge portion of the front open end of the insulator 2. This makes it possible to substantially delay an advancement of the channeling of the insulator and to improve the fouling resistance.

(c) With the noble metal alloy portion 34 circumferentially provided around the front end portion of the center electrode metal 30, it is possible to prevent the spark erosion so as to ameliorate the durability. It is preferable that the height (a) of the noble metal alloy portion 34 is 0.3–1.5 mm, and its thickness (b) is 0.2–0.5 mm in supressing the spark erosion and reducing the cost with a least volume of the noble metal or noble metal alloy to be used.

Figure 6:
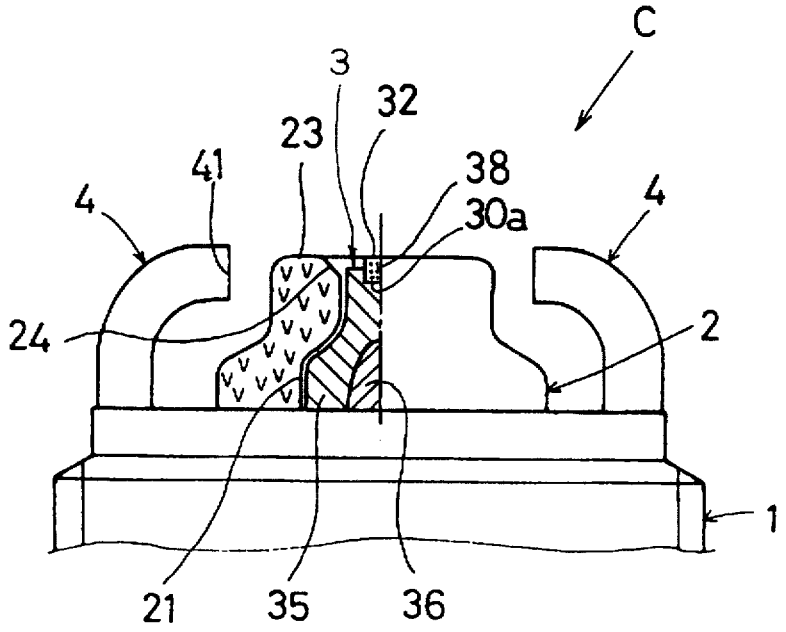
FIG. 6 is a longitudinal cross sectional view of a main portion of a dual-gap type spark plug according to a third embodiment of the invention.
Figure 7:
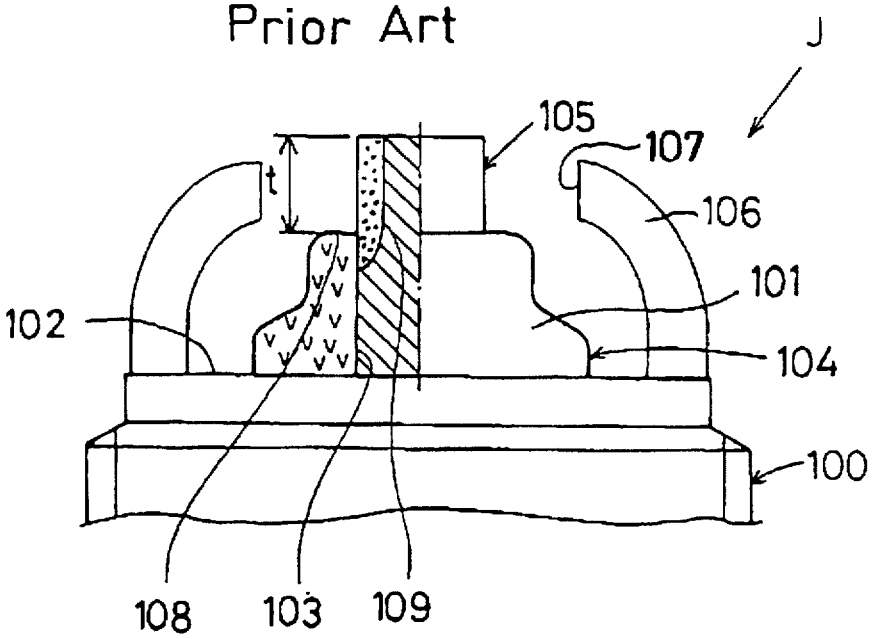
Fig.7 Prior Art
FIG. 7 is a longitudinal cross sectional view of a main portion of a dual-gap type spark plug in the prior art.

Referring still further to FIG. 6 which relates to a dual-gap type spark plug (C) according to a third embodiment of the invention, the spark plug (C) has the cylindrical metal shell 1 in which the insulator 2 is fixedly placed. Within the axial bore 21 of the insulator 2, the center electrode 3 is firmly placed whose front end has a noble metal portion 38. The outer electrodes 4, 4 are extended from the front end 11 of the metal shell 1 and bent to space oppose to the insulator 2 whose front end surface 23 is almost flush with the front end 32 of the noble metal portion 38 of the center electrode and is in line with the firing end 41 of the outer electrode 4.

Instead of the circumferential groove 303 trapezodal in cross section of the second embodiment of the invention, a cavity 30*a* is provided on the front end surface of the center electrode metal 30 as shown in the third embodiment (FIG. 6). Within the cavity 30*a*, a disk-like noble metal tip made of Pt-20Ir alloy is loaded, and laser-welded to an inner wall of the cavity 30*a* so as to form the noble metal portion 38 at the center electrode end. In this situation, the front or rather top end surface 32 of the noble metal portion 38 is substantially in flush with that of the insulator 2 which keeps abreast with the center of the outer electrode 4.

In the case in which the noble metal alloy portion 34 is placed around all through the circumferential length of the front elevational side of the center electrode metal 30 as in FIG. 4*b*, the spark discharge may selectively occurs at the Ni-based alloy 35 behind the noble metal alloy portion 34 so as to aggravate the channeling when the noble metal alloy portion 34 is unilaterally eroded due to a diverted spark discharge paths. On the contrary, it may be possible to obviate such aggravation of the channeling due to the one-sided erosion, with the arrangement of the noble metal portion 38 in the center electrode 35 according to the third embodiment of the invention as shown in FIG. 6.

MODIFICATION FORMS (a) The number of the outer electrodes connected to the metal shell 1 may be three or four. This disperses the spark discharge paths to ease the one-sided spark erosion of the center electrode and/or the advancement of the channeling of the insulator. With the increased number of the outer electrodes, it is possible to facilitate the self-cleaning action so as to improve the carbon fouling resistance of the spark plug.

(b) Instead of using the annular platinum wire 340 to be laser-welded, an other noble metal wire may be encircled around an inner wall of the groove 303 with its leading end of the wire provisionally bonded to an inner wall of the groove 303 by means of a resistance welding procedure, and the wire is severed at an appropriate length and welded to the groove 303 completely.

(c) After welding the ring-shaped noble metal tip around the elevational front end of the center electrode metal 30 by the resistance welding, the center electrode metal 30 may be formed by a extrution process. This may contribute to manufacture of the center electrode 3 with a relatively low cost.

(d) The center electrode 3 and/or the outer electrode 4 may have a heat-conductor core of copper or copper based alloy in the Nickel or Ni-based alloy.

(e) The center electrode made of the Ni-based alloy having 2.0–2.5 m in diameter may be effective for maintaining the spark erosion resistance especially when the front end of the center electrode is configulated as shown in FIG. 6.

(f) The front end surface of the insulator should be in line with the outer electrode, but it may be optimized that the front end surface is located in line between the center and the inward edge of the outer electrode.

While the invention has been described with reference to the specific embodiments, it is understood that this description is not to be construed in a limitting sense in as much as various modifications and additions to the specific embodiments may be made by skilled artisan without departing from the scope of the invention.

What is claimed is:

1. A spark plug comprising:

a cylindrical metal shell, an insulator placed in the metal shell in a manner to extend a front end of the insulator beyond the metal shell;

a center electrode placed within an axial bore provided by the insulator; and an outer electrode bonded to a front end of the metal shell and so bent that a firing end of the outer electrode faces a front end portion of the insulator with a space therebetween to cause spark discharges along a front end surface of the insulator;

wherein a front end of the center electrode protrudes from the front end surface of the insulator by not more than 0.5 mm or is retracted from the front end surface of the insulator by not more than 1.0 mm, and the front end surface of the insulator is in line with the firing end of the outer electrode;

wherein a noble metal tip is welded to the center electrode at a location within the bore of the insulator to form the front end of the center electrode; and wherein the noble metal tip has a disk-shaped configuration having a diameter between 1.0 and 2.5 mm and a thickness between 0.3 and 1.0 mm.

2. A spark plug comprising:

a cylindrical metal shell, an insulator placed in the metal shell in a manner to extend a front end of the insulator beyond the metal shell;

a center electrode placed within an axial bore provided by the insulator; and at least one outer electrode bonded to a front end of the metal shell and so bent that a firing end of the outer electrode faces a front end portion of the insulator with a space therebetween to cause spark discharges along a front end surface of the insulator;

wherein a front end of the center electrode is flush with the front end surface of the insulator, and the front end surface of the insulator is in line with the firing end of the outer electrode;

wherein a noble metal tip is welded to the center electrode at a location within the bore of the insulator to form the front end of the center electrode; and wherein the noble metal tip has a disk-shaped configuration having a diameter between 1.0 and 2.5 mm and a thickness between 0.3 and 1.0 mm.

3. A spark plug as recited in claim 2, wherein an inner edge of the front end surface of the insulator is bevelled.

4. A spark plug as recited in claim 2, wherein the number of the outer electrode is at least two.

5. A spark plug as recited in claim 4, wherein the outer electrode has a strip-like shape.

6. A spark plug as recited in claim 1, wherein an inner edge of the front end surface of the insulator is bevelled.

7. A spark plug as recited in claim 1, wherein the number of the outer electrode is at least two.

8. A spark plug as recited in claims 1 or 2, wherein the noble metal tip is placed circumferentially around a front end portion of the center electrode metal to form the front end of the center electrode.

9. A spark plug as recited in claim 8, wherein the annular noble metal tip, which is the same or less than the center electrode in outer diameter, measures 0.3~1.5 mm in height and 0.2~0.5 mm in thickness.

10. A spark plug as recited in claim 1 or 2, wherein the noble metal tip is annular-shaped and welded circumferentially around a front end portion of the center electrode metal, by applying a laser to an interfacing portion between the noble metal tip and the center electrode.

11. A spark plug as recited in claim 1 or 2, wherein the front end of the center electrode has the noble metal tip connected by an electric resistence welding.

12. A spark plug as recited in claim 1 or 2, wherein a high tension spark discharge voltage applied to the center electrode is in a negative polarity.

13. A spark plug comprising:

a cylindrical metal shell, an insulator placed in the metal shell in a manner to extend a front end of the insulator beyond the metal shell;

a center electrode placed within an axial bore provided by the insulator; and an outer electrode bonded to a front end of the metal shell and so bent that a firing end of the outer electrode faces a front end portion of the insulator with a space therebetween to cause spark discharges along a front end surface of the insulator;

wherein a front end of the center electrode protrudes from the front end surface of the insulator by not more than 0.5 mm or is retracted from the front end surface of the insulator by not more than 1.0 mm, and the front end surface of the insulator is in line with the firing end of the outer electrode; and wherein the diameter of the center electrode is between 1.0 and 2.5 mm.

14. A spark plug as recited in claim 13, wherein the outer electrode includes has a strip-like shape.

15. A spark plug comprising:

a cylindrical metal shell, an insulator placed in the metal shell in a manner to extend a front end of the insulator beyond the metal shell;

a center electrode placed within an axial bore provided by the insulator; and at least one outer electrode bonded to a front end of the metal shell and so bent that a firing end of the outer electrode faces a front end portion of the insulator with a space therebetween to cause spark discharges along a front end surface of the insulator;

wherein a front end of the center electrode is flush with a front end surface of the insulator, and the front end surface of the insulator is in line with the firing end of the outer electrode; and wherein the diameter of the center electrode is between 1.0 and 2.5 mm.

* * * * *